US011117397B2

(12) United States Patent
Lee

(10) Patent No.: US 11,117,397 B2
(45) Date of Patent: Sep. 14, 2021

(54) PHOTO PRINTER

(71) Applicant: DS GLOBAL, Seoul (KR)

(72) Inventor: Yong Duk Lee, Gunpo-si (KR)

(73) Assignee: DS GLOBAL, Seoul (KR)

( * ) Notice: Subject to any disclaimer, the term of this patent is extended or adjusted under 35 U.S.C. 154(b) by 0 days.

(21) Appl. No.: 16/757,095

(22) PCT Filed: Oct. 4, 2018

(86) PCT No.: PCT/KR2018/011740

§ 371 (c)(1),
(2) Date: Apr. 17, 2020

(87) PCT Pub. No.: WO2019/078518

PCT Pub. Date: Apr. 25, 2019

(65) Prior Publication Data

US 2020/0338911 A1 Oct. 29, 2020

(30) Foreign Application Priority Data

Oct. 18, 2017 (KR) ..... 10-2017-0135003
Oct. 24, 2017 (KR) ..... 10-2017-0138154
Nov. 17, 2017 (KR) ..... 10-2017-0153773

(51) Int. Cl.
*B41J 11/04* (2006.01)
*B41J 2/32* (2006.01)
(Continued)

(52) U.S. Cl.
CPC ..... *B41J 11/04* (2013.01); *B41J 2/32* (2013.01); *B41J 13/03* (2013.01); *B41J 25/308* (2013.01); *B41J 29/17* (2013.01)

(58) Field of Classification Search
CPC ..... B41J 13/10; B41J 11/04; B41J 2/32; B41J 25/312; B41J 13/00; B41J 13/103;
(Continued)

(56) References Cited

U.S. PATENT DOCUMENTS 6,769,683 B2 * 8/2004 Hiramatsu ..... B65H 5/06 271/274

FOREIGN PATENT DOCUMENTS

JP 06008571 1/1994
JP 2002284389 10/2002
(Continued)

OTHER PUBLICATIONS

International Search Report—PCT/2018/011740 dated Jan. 24, 2019.

*Primary Examiner* — Jannelle M Lebron
(74) *Attorney, Agent, or Firm* — Cantor Colburn LLP

(57) ABSTRACT

Provided is a photo printer including: a base for accommodating paper therein; a pick-up roller protruding from a bottom surface of the base to feed the paper accommodated in the base in a forward direction; a platen roller for discharging in the forward direction the paper; a head provided above the platen roller to apply heat to the paper; a swing bracket having a front side to which the head is coupled and a rear side rotatably coupled to the base; pressurizing means for pressurizing the swing bracket down to allow the swing bracket to come into close contact with the paper; and head supporting members provided on side walls of the base to support the front side of the swing bracket under the swing bracket and each having an eccentric portion adapted to lift the head up through rotation.

9 Claims, 11 Drawing Sheets

(51) Int. Cl.
*B41J 13/03* (2006.01)
*B41J 25/308* (2006.01)
*B41J 29/17* (2006.01)

(58) Field of Classification Search
CPC . B41J 29/38; B41J 13/03; B41J 25/308; B41J 29/17
See application file for complete search history.

(56) References Cited

FOREIGN PATENT DOCUMENTS

| | | |
|---|---|---|
| JP | 2009045826 | 3/2009 |
| JP | 2009184805 | 8/2009 |
| KR | 20170082404 | 7/2017 |

* cited by examiner (a)

(b)

(a)

(b)

PHOTO PRINTER

TECHNICAL FIELD

The present invention relates to a photo printer, and more particularly, to a photo printer that is capable of allowing head supporting members each having an eccentric portion to be rotated to form a gap between a head and a platen roller.

BACKGROUND ART

A camera mounted on a smart device like a smartphone has similar performance to a general digital camera, and many people have taken their pictures with their smart device carried always with them, not with a digital camera. Accordingly, a consumer's desire to take his or her picture and to instantly print the picture, without any separate conversion for the picture, has been gradually increased.

So as to satisfy such consumer's desire, photo printers have been proposed so that pictures on smartphones can be instantly printed whenever and wherever.

There are various kinds of photo printers, but among them, particularly, a photo printer is proposed wherein printing paper to which a zero-ink printing technology is adopted is used, thereby requiring no ink or cartridge to reduce the maintenance cost thereof. In case of such zero-ink printing technology, the part corresponding to the cartridge is contained in the paper, and accordingly, only heat is used to express colors. That is, dyes, which respond to heat and thus express colors, are laminated on the paper, so that the heating temperature or heating time of a head is controlled to print images (pictures) or texts.

A conventional photo printer will be explained with reference to FIGS. 1 to 3. As shown, the conventional photo printer includes a base 110, a pickup roller R1, a platen roller R2, a head 140, a swing bracket 150, and pressurizing means 160.

The base 110 has a paper feeding part disposed thereon to stackedly accommodate a plurality of sheets of paper therein and a lower base 115 extended forward from the underside thereof.

The pickup roller R1 protrudes from a bottom surface of the paper feeding part of the base 110 to forward feed the paper located at the lowermost position among the stacked paper.

The platen roller R2 is adapted to discharge the paper fed by the pickup roller R1 forward and has a rotary shaft coupled to the lower base 115.

The head 140 is disposed above the platen roller R2 and is adapted to apply given heat to the paper to express colors corresponding to the given heat, thereby printing images or texts. Further, a ceramic plate (not shown) is disposed on top of the head 140, and a heat sink 141, which is made of a metal material, is placed on top of the ceramic plate.

Further, a PCB 142 is provided to control a heating temperature and heating time of the head 140. In detail, the head 140 and the PCB 142 are attached to the underside of the heat sink 141.

The paper enters a space between the head 140 and the platen roller R2, and especially, the head 140 is not fixed to the base 110 but rotatably mounted onto the base 110. In detail, the head 140 is coupled to a mounting part 151 disposed on the front side of the swing bracket 150.

So as to allow the space between the head 140 and the platen roller R2 to be widened at the time when the paper enters the space between the head 140 and the platen roller R2, further, hinge holes 152 are formed on the rear side of the swing bracket 150 in such a manner as to be coupled to rotary shafts 113 disposed on the side walls of the base 110.

Furthermore, the head 140 comes into close contact with the paper to apply the heat to the paper, and so as to allow the head 140 to come into close contact with the paper, the pressurizing means 160 is provided to pressurize the head 140 downward. The pressurizing means 160 includes a pressurizing part 161 for pressurizing top of the head 140 and hinge holes for rotating the pressurizing part 161 coaxially with respect to the rotary shaft 113 of the swing bracket 150.

Even though the top of the head 140 is pressurized against the pressurizing means 160, locking projections 153 of the swing bracket 150 are locked onto stoppers 115*a* formed on both sides of the base 110, and accordingly, they are not descended anymore, so that the head 140 does not come into contact with the platen roller R2, thereby forming a gap from the platen roller R2.

Under the configuration of the conventional photo printer, like this, the formation of the gap between the head 140 and the platen roller R2 at the time when the head 140 is coupled to the base 110 is achieved by means of the locking projections 153 and the stoppers 115*a*, which undesirably causes the gap to be not constant. In more detail, gaps on both sides of the head 140 may be different from each other due to mechanical errors of the locking projections 153 and the stoppers 115*a*, and further, gaps after assembled may be different from set gaps.

Also, the platen roller is provided with rubber for feeding the paper therethrough. As the platen roller is pressurized against the head, the rubber becomes compressedly deformed in shape. In this case, the platen roller has to be exchanged with new one, but undesirably, a process of exchanging the platen roller may be very complicated.

If foreign substances are attached to the platen roller R2, moreover, vertical lines may be formed on an image, and the foreign substances may be also transferred to the head. As a result, a quality of printing may be deteriorated badly.

DISCLOSURE

Technical Problem

Accordingly, the present invention has been made in view of the above-mentioned problems occurring in the related art, and it is an object of the present invention to provide a photo printer that is capable of allowing a gap between a head and a platen roller to be formed constantly.

It is another object of the present invention to provide a photo printer that is capable of allowing a platen roller to be easily detachable therefrom, thereby making it easy to perform maintenance or repair of the platen roller.

It is yet another object of the present invention to provide a photo printer that is capable of preventing foreign substances from being attached to an outer peripheral surface of a platen roller, thereby improving a quality of printing.

Technical Solution

To accomplish the above-mentioned objects, according to the present invention, there is provided a photo printer including: a base for accommodating paper therein; a pick-up roller protruding from a bottom surface of the base to feed the paper accommodated in the base in a forward direction; a platen roller for discharging in the forward direction the paper fed by means of the pick-up roller; a head provided above the platen roller to apply heat to the paper; a swing bracket having a front side to which the head is coupled and a rear side rotatably coupled to the base; pressurizing means for pressurizing the swing bracket down to allow the swing bracket to come into close contact with the paper entering a space between the head and the platen roller; and head supporting members provided on side walls of the base to support the front side of the swing bracket under the swing bracket and each having an eccentric portion adapted to lift the head up through rotation and thus to form a gap between the head and the platen roller.

According to the present invention, desirably, each head supporting member has gear teeth adapted to engage with gear teeth of a jig so that the eccentric portion is rotated.

According to the present invention, desirably, the photo printer further includes a fixing pin adapted to pass through each head supporting member in such a manner as to be fixed to the side wall of the base, and the head supporting member has a long hole formed thereon to pass the fixing pin therethrough so that in a state where the fixing pin is coupled to the side wall of the base, the head supporting member is rotated.

According to the present invention, desirably, the base has open portions formed on both side walls thereof in such a manner as to detachably mount a shaft of the platen roller thereon.

According to the present invention, desirably, ring-shaped bushings whose diameters are greater than widths of the open portions are fitted to the shaft of the platen roller, and each bushing has D-cut portions linearly cut on portions of an outer peripheral surface thereof, so that the bushings pass through the open portions and are then detachably mounted on the base.

According to the present invention, desirably, the base has seating portions open to a shape of a circle on both side walls thereof to seat the bushings onto the ends of the open portions.

According to the present invention, desirably, each bushing is formed integrally with one side of the corresponding head supporting member.

According to the present invention, desirably, the photo printer further includes cleaning means for removing foreign substances attached to the platen roller.

According to the present invention, desirably, the cleaning means is formed of a brush or fabric cleaning pad located on the front end of the base in such a manner as to come into contact with the platen roller.

Advantageous Effects

According to the present invention, the photo printer is capable of rotating the head supporting members each having the eccentric portion to form a given gap between the head and the platen roller.

Accordingly, the photo printer according to the present invention is capable of accurately forming a given gap between the head and the platen roller, while being not under the influence of the mechanical error generated from the stoppers and the locking projection or the assembling error generated when the head is coupled to the base in the conventional practices.

Further, the photo printer according to the present invention is capable of fixing the head supporting members to the base, thereby allowing the adjusted gap to be maintained, without any arbitrary change.

Also, the photo printer according to the present invention is capable of allowing the platen roller to be easily detachably mounted on the base, thereby making it easy to exchange or repair the platen roller.

In addition, the photo printer according to the present invention is capable of preventing the foreign substances from being attached to the outer peripheral surface of the platen roller.

BRIEF DESCRIPTION OF DRAWINGS

FIGS. 7 to 10*b* show a photo printer according to a second embodiment of the present invention.

BEST MODE FOR INVENTION

Hereinafter, an explanation on a configuration and an operation of a photo printer according to a first embodiment of the present invention will be in detail given with reference to the attached drawings.

Figure 1:
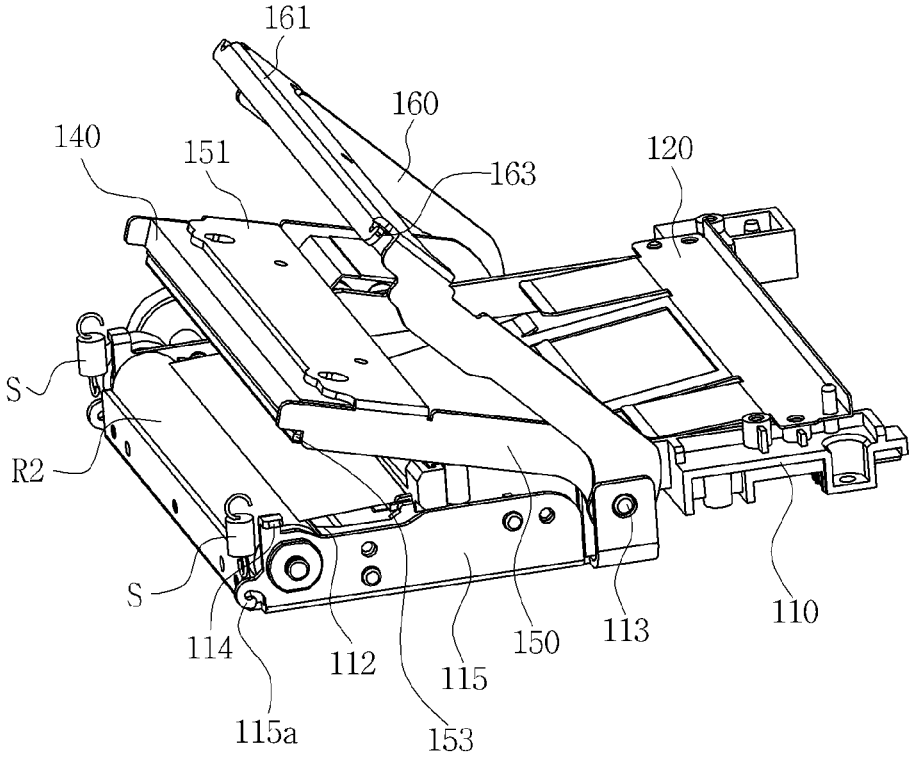
FIG. 1 Prior Art
FIGS. 1 to 3 show a conventional photo printer.
Figure 2:
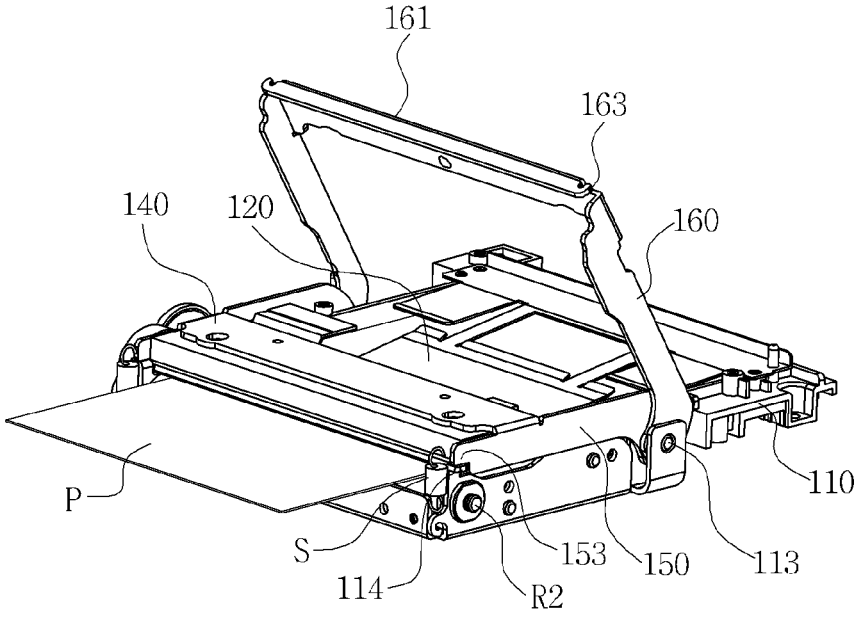
FIG. 2 Prior Art
Figure 3:
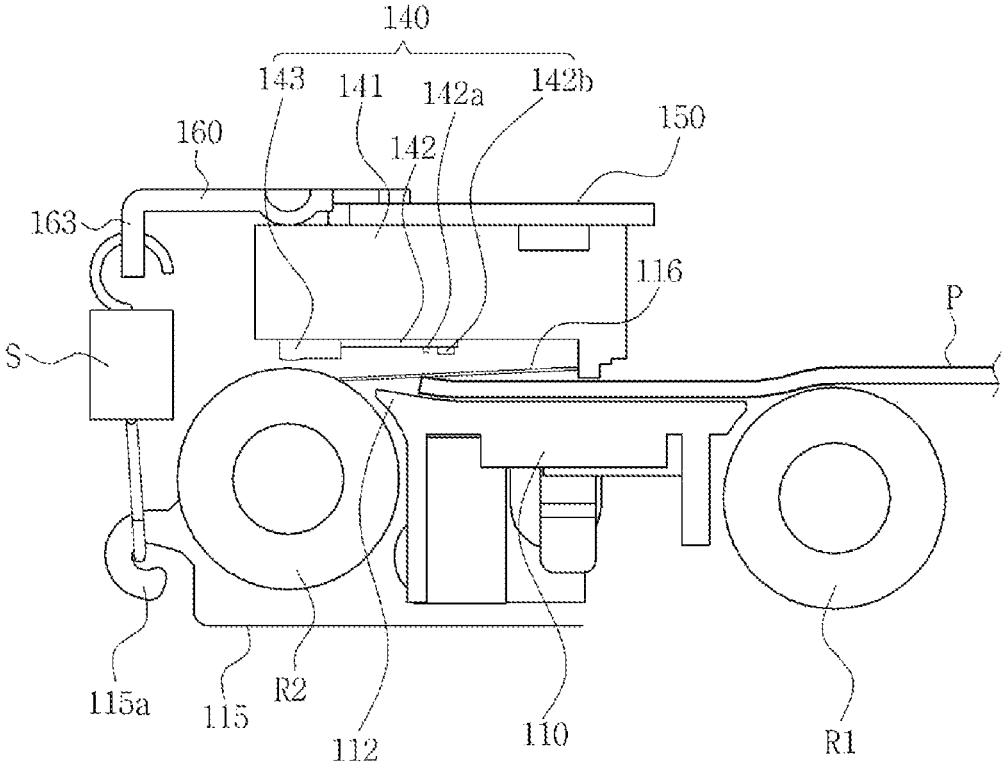
FIG. 3 Prior Art
Figure 4:
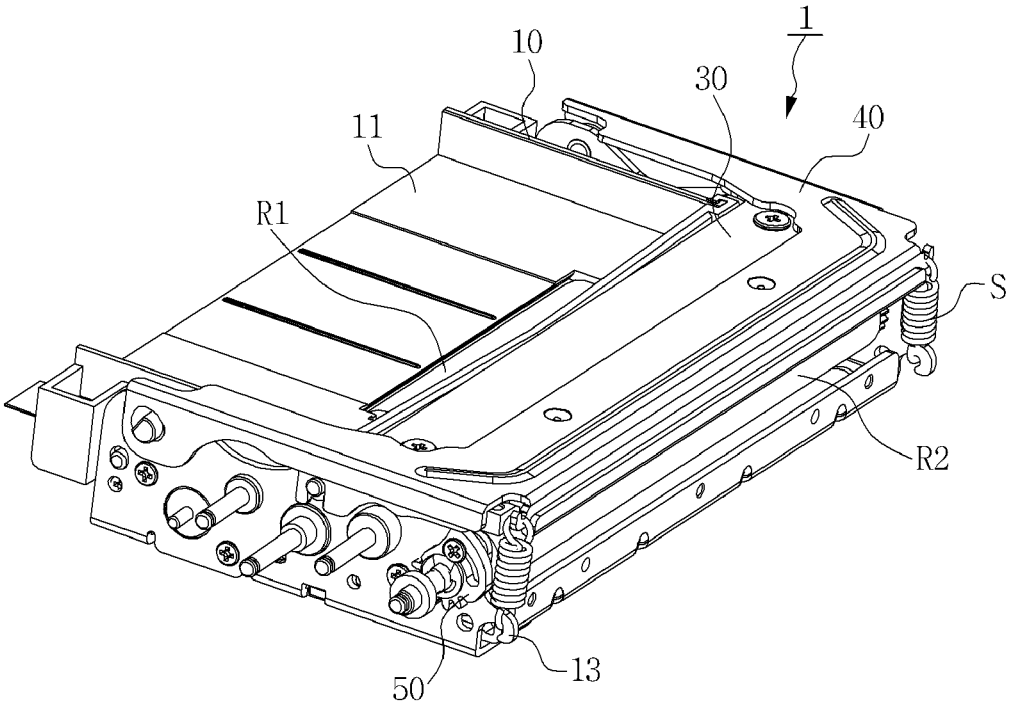
FIGS. 4 to 6 show a photo printer according to a first embodiment of the present invention.
Figure 5:
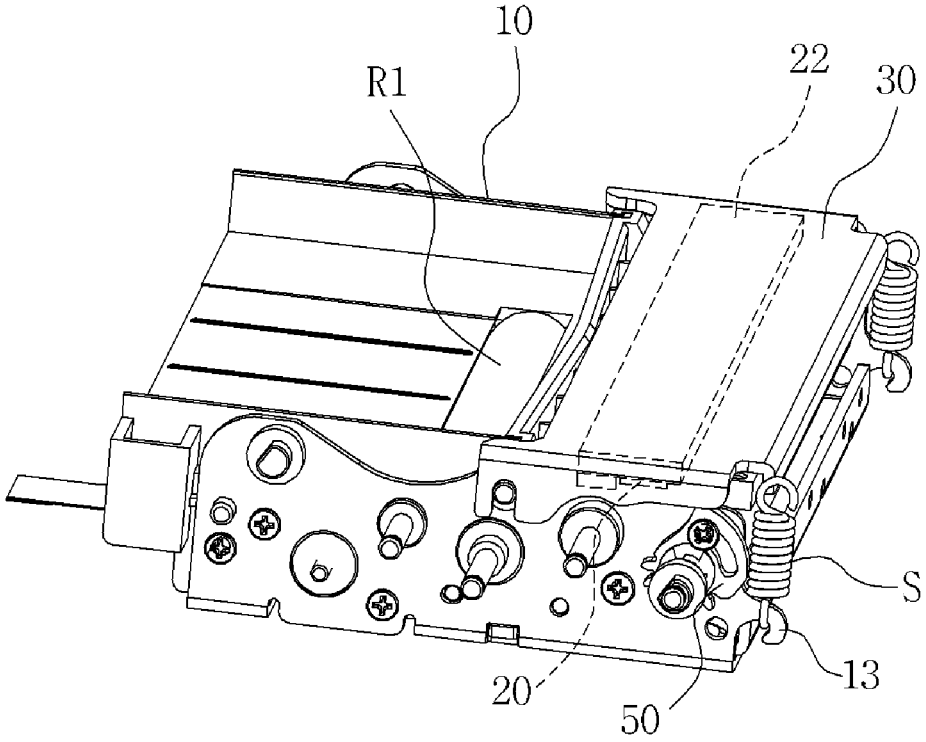
Figure 6:
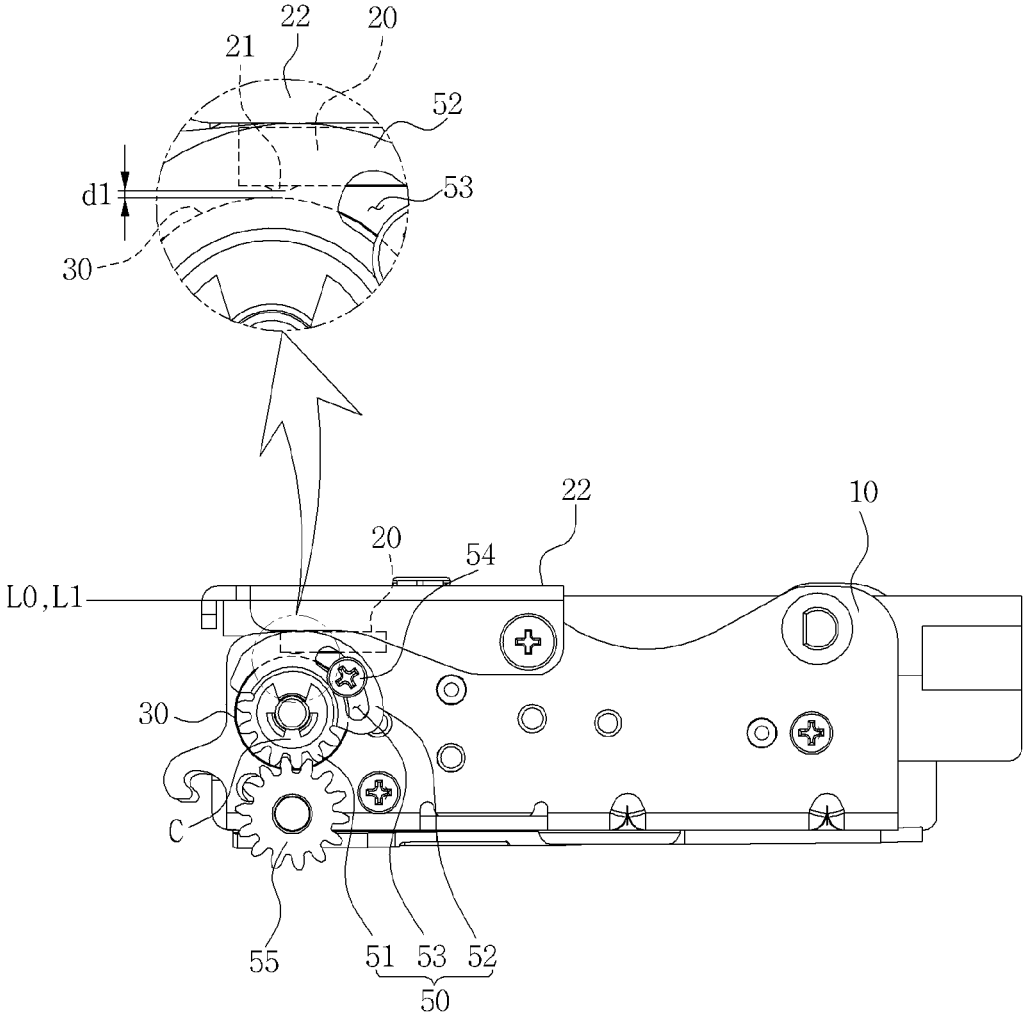

As shown in FIGS. 4 to 6, a photo printer 1 according to a first embodiment of the present invention includes a base 10, a pickup roller R1, a platen roller R2, and a head 20.

The base 10 has a shape of a general plate whose both sides are bent to thus form side walls and has a paper accommodating part 11 adapted to accommodate paper therein.

The pickup roller R1 protrudes from a bottom surface of the base 10 to feed the paper accommodated in the paper accommodating part 11 in a forward direction.

The platen roller R2 is adapted to discharge the paper fed from the pickup roller R1 forward. A shaft of the platen roller R2 is coupled to both side walls of the base 10. The base 10 is provided with a motor, and a driving force of the motor is transferred to the platen roller R2 by means of a gear assembly (See 'G' of FIG. 12) provided on one side wall of the base 10.

The head 20 is disposed above the platen roller R2 to apply heat to the paper. The head 20 has heating elements 21 disposed thereon in a transverse direction thereof in such a manner as to come into direct contact with the paper with a given pressure. Further, the head 20 has a heat sink 22 disposed on top thereof to radiate heat therefrom.

Further, the heating elements 21 of the head 20 have to come into contact with the paper with the given pressure. To do this, the photo printer according to the present invention is configured to allow the head 20 to be coupled to a front side of a swing bracket 30 and includes pressurizing means 40 rotatably coupled to top of the swing bracket 30 and springs S adapted to pull the pressurizing means 40 downward.

In detail, the head 20 is coupled to the front side of the swing bracket 30, and the base 10 is hinge-coupled to the rear side of the swing bracket 30.

The pressuring means 40 is hinge-coupled to the base 10 in such a manner as to cover a portion of the swing bracket 30 on top of the swing bracket 30.

One side of each spring S is connected to the pressurizing means 40, and the other side thereof to a locking projection 13 of the base 10.

Under the above-mentioned configuration, the swing bracket 30 is elastically pulled downward by means of the springs S, so that the head 20 comes into close contact with the platen roller R2.

Further, head supporting members 50 are provided to form a gap between the head 20 and the platen roller R2, so that through the gap, the paper is easily introduced.

Referring to FIG. 6, the head supporting members 50 serve to support the head 20 under the swing bracket 30. Each head supporting member 50 has an eccentric portion 52 adapted to lift the head 20 up, while rotating. In detail, the eccentric portion 52 has a shape of an arch, but the center of the eccentric portion 52 does not correspond to the center of the head supporting member 50.

The head supporting members 50 are rotatably disposed on both side walls of the base 10. According to the present invention, in more detail, the head supporting members 50 are fitted to both ends of a shaft of the platen roller R2.

The center of the eccentric portion 52 is different from that of the head supporting member 50, and as the head supporting members 50 are rotated, accordingly, a gap dl between the head 20 and the platen roller R2 becomes changed according to the rotation of the head supporting members 50 (See FIG. 6). In detail, as shown in FIG. 6, if the head supporting members 50 are rotated in a clockwise direction, the gap dl between the head 20 and the platen roller R2 becomes large, and if the head supporting members 50 are rotated in a counterclockwise direction, the gap dl between the head 20 and the platen roller R2 becomes small. It can be therefore appreciated that the gap dl between the head 20 and the platen roller R2 can be adjusted according to the rotation of the head supporting members 50.

So as to prevent the adjusted gap dl from being arbitrarily changed, further, each head supporting member 50 has an arch-shaped long hole 53 and a fixing pin 54 passing through the long hole 53 in such a manner as to be fixed to the side wall of the base 10. The formation of the long hole 53 to the shape of an arch enables the head supporting member to be rotated in a state where the fixing pin 54 is loosely coupled to the side wall of the base 10.

Through the rotation of the head supporting members 50, in detail, the desired gap dl between the head 20 and the platen roller R2 is formed, and next, the fixing pins 54 are fastened to the side walls of the base 10, so that the head supporting members 50 are fixed to the base 10, without any rotation.

Furthermore, rotary jigs 55 are provided to easily rotate the head supporting members 50 in the state where the head supporting members 50 are fixed to the base 10. The rotary jigs 55 have gear teeth adapted to engage with gear teeth 51 formed on the head supporting members 50, and as the gear teeth of the rotary jigs 55, which engage with the gear teeth 51, are rotated, the head supporting members 50 can be easily rotated.

The rotary jigs 55 are set tools which form the gap between the head 20 and the platen roller R2, and accordingly, they are just used in a manufacturing process of the photo printer. Therefore, the rotary jigs 55 are not parts of the photo printer according to the present invention, and after the gap has been formed, they are separated from the head supporting members 50.

MODE FOR INVENTION

Hereinafter, a photo printer according to a second embodiment of the present invention will be explained. A photo printer 1 according to the second embodiment of the present invention is configured to allow a shaft sh of a platen roller R2 to be rotatably fixed to both side walls of the base 10, but if necessary, configured to allow the platen roller R2 to be detachable from the base 10.

Figure 7:
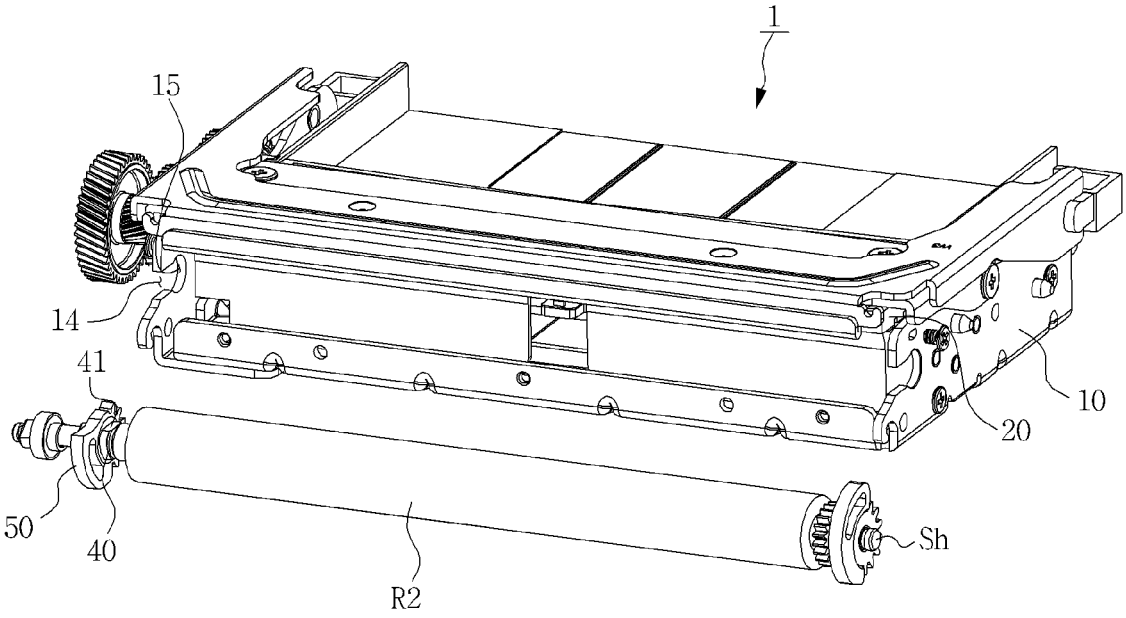
Figure 8:
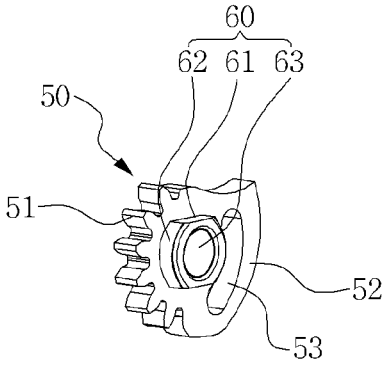
Figure 9:
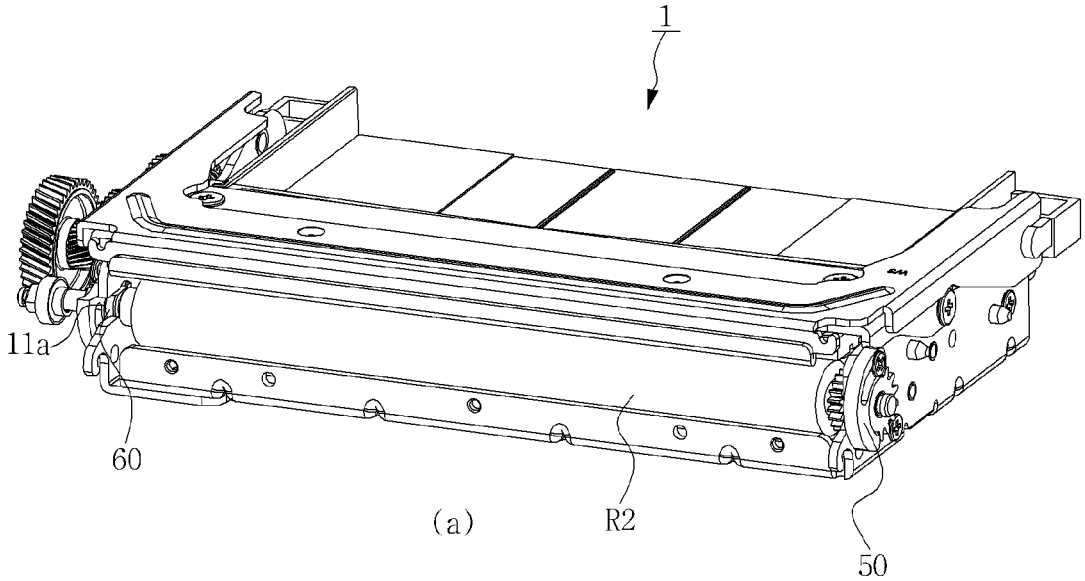
Figure 9:
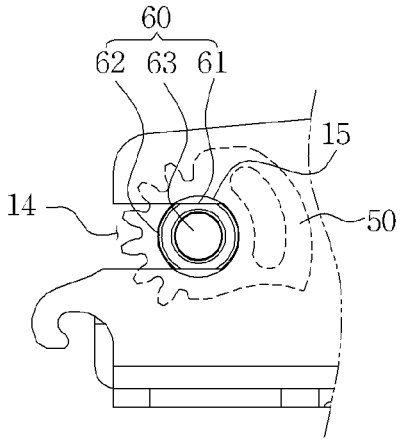
Figure 10:
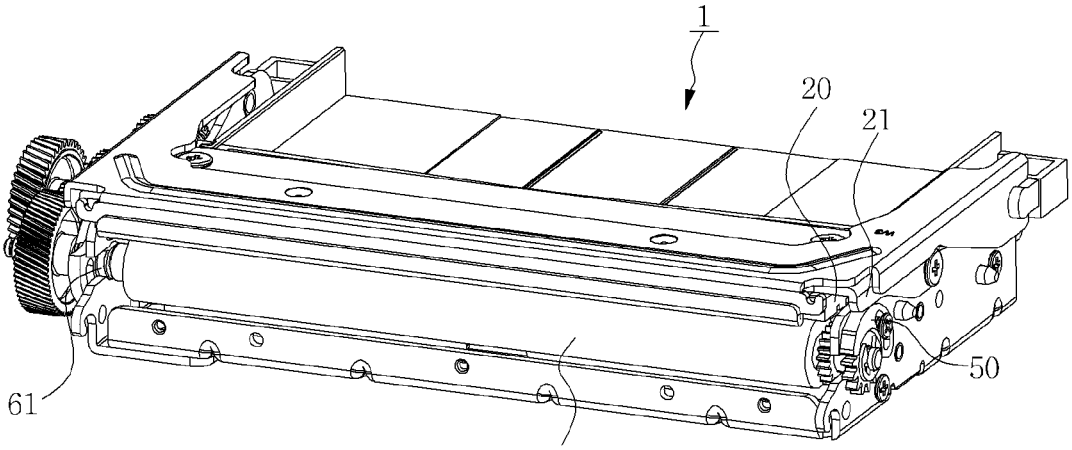
Figure 10:
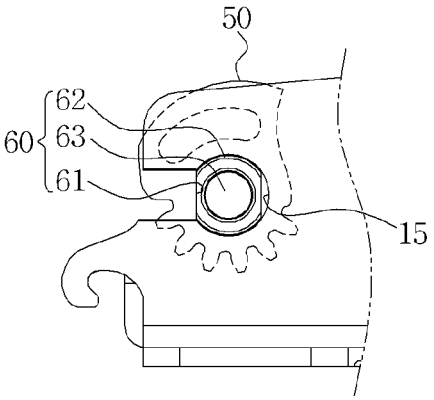

Referring to FIGS. 7 and 8, the base 10 has open portions 14 formed on both side walls thereof in such a manner as to pass the shaft sh of the platen roller R2 therethrough and thus to mount or demount the platen roller R2 thereon or therefrom. The open portions 14 are formed up to the front end of the base 10 from a position of the base 10 where the shaft sh of the platen roller R2 is mounted.

Further, ring-shaped bushings 60 are fitted to both sides of the shaft sh of the platen roller R2. Accordingly, each bushing 60 has a shaft hole 63 formed at the center thereof in such a manner as to pass the shaft sh of the platen roller R2 therethrough. A diameter (outer diameter) of each bushing 60 is larger than a width of the open portion 14.

Each ring-shaped bushing 60 has arch portions 62 and D-cut portions 61 formed on positions where the arch portions 62 face each other. In detail, the bushing 60 has the two arch portions 62 and the two D-cut portions 61 alternately formed along the outer peripheral surface thereof.

The D-cut portions 61 are formed by linearly cutting portions of the outer peripheral surface of the bushing 60, and a width between the facing D-cut portions 61 is equal to or smaller than the width of the open portion 14. If the two D-cut portions 61 are parallel with the open portions 14, accordingly, the bushings 60 can pass through the open portions 14.

Moreover, the base 10 has seating portions 15 open to a shape of a circle on both side walls thereof to seat the bushings 60 thereonto. The seating portions 15 are extended from the ends of the open portions 14.

According to the present invention, further, the bushings 60 are formed integrally with one side of the head supporting members 50. Accordingly, the platen roller R2 passes through the centers of the head supporting members 50 and the centers of the bushings 60.

According to the present invention, the bushings 60 and the head supporting members 50 are fitted to both ends of the platen roller R2, but of course, they may be fitted only to one end of the platen roller R2. In this case, one seating portion 15 is formed on one side wall of the base 10.

Now, an explanation on a process of mounting the platen roller R2 onto the base 10 will be given with reference to FIGS. 9*a* to 10*b*.

As shown in FIGS. 9*a* and 9*b*, first, the platen roller R2 is rotated to allow the two D-cut portions 61 to be parallel with the open portion 14, so that the bushings 60 fitted to both sides of the platen roller R2 can pass through the open portions 14. At this time, the two D-cut portions 61 are located at the left and right sides of each bushing 60. In this state, the D-cut portions 61 pass through the open portion 14, so that the bushings 60 are seated onto the seating portions 15.

As shown in FIGS. 10*a* and 10*b*, the platen roller R2 is rotated to an angle of 90° to allow the two D-cut portions 61 to be located up and down, and the arch portions 62 are located on the front surface of the open portion 14.

If the platen roller R2 is rotated, like this, the arch portions 62 of the bushings 60 cannot pass through the open portions 14, so that the platen roller R2 can be stably mounted on the base 10, without any escape from the base 10.

Lastly, C-rings (See a reference numeral 'C' of FIG. 6) are fitted to both side ends of the shaft sh of the platen roller R2 to allow the platen roller R2 to be fixed to both side walls of the base 10.

If the platen roller R2 has to be detached from the base 10 so as to exchange or repair it, further, the C-rings are separated from the shaft sh of the platen roller R2, and after that, the platen roller R2 is rotated to an angle of 90° again to allow the two D-cut portions 61 to be located on the front surface of the open portion 14.

In this state, the two arch portions 62 are located up and down, and the D-cut portions 61 pass through the open portions 14 to allow the platen roller R2 to be detached from the base 10.

According to the present invention, each bushing 60 has the two D-cut portions 61 and the two arch portions 62, but of course, it may have three or more D-cut portions and three or more arch portions alternately formed thereon. Otherwise, the bushing 60 may have D-cut portions formed continuously on arch portions. For example, the bushing may have shapes of hexagon and heptagon. In detail, the bushing can be freely changed in shape only if it can pass through the open portions 14 by means of the D-cut portions and cannot pass through the open portions 14 if rotated.

Figure 11:
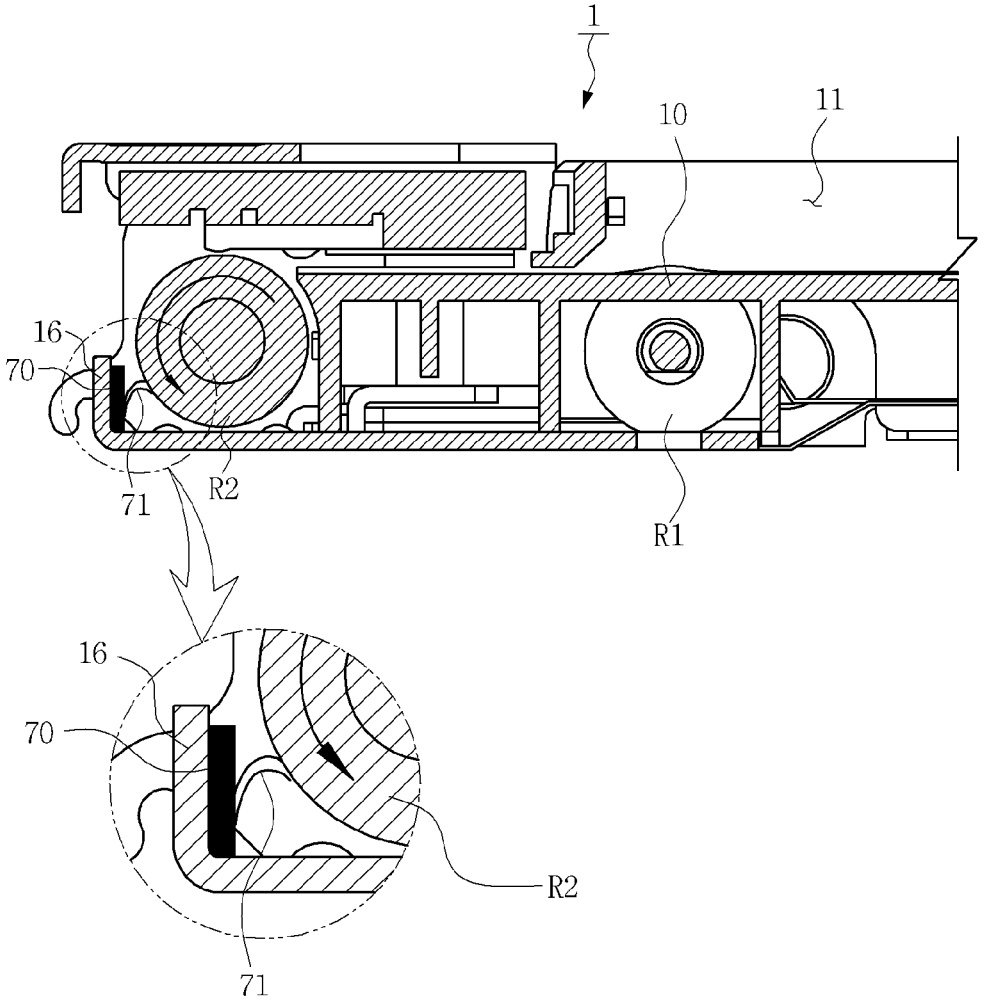
FIGS. 11 to 13 show a photo printer according to a third embodiment of the present invention.
Figure 12:
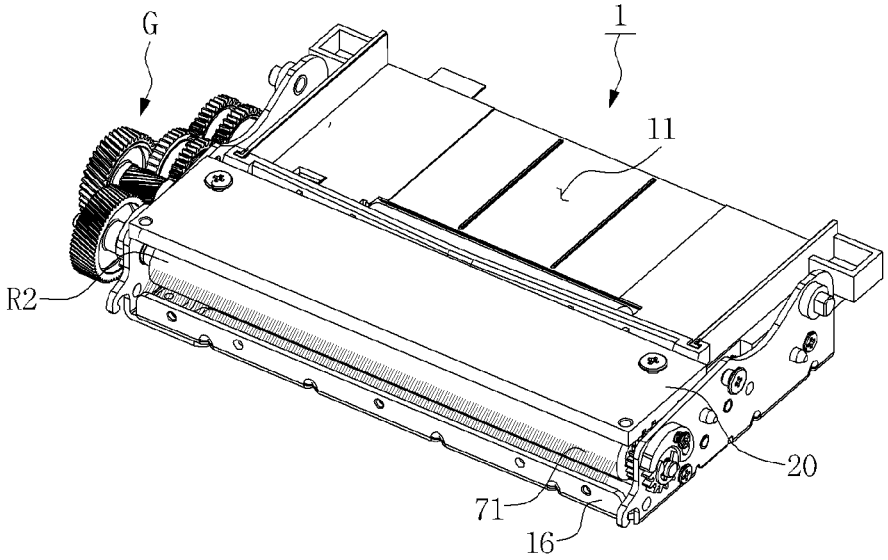
Figure 13:
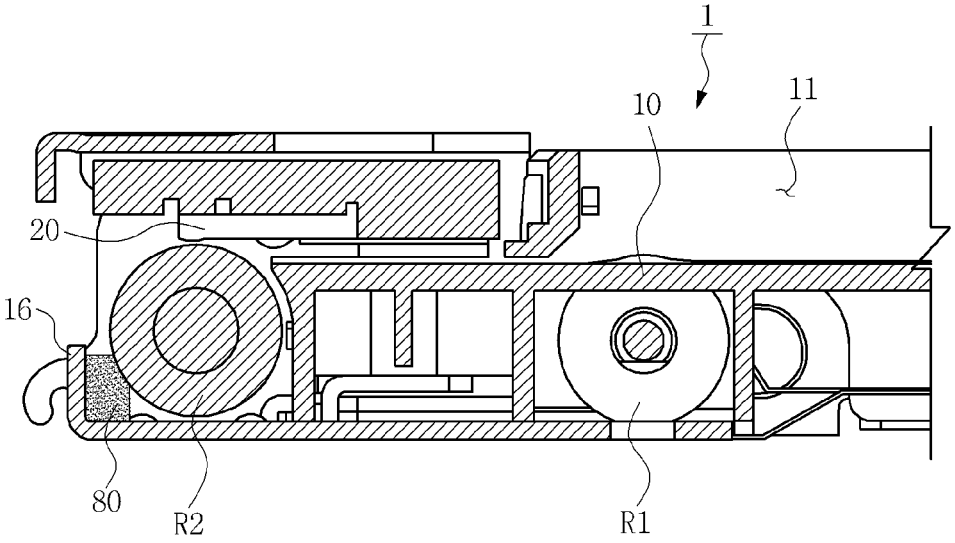

FIGS. 11 to 13 show a photo printer according to a third embodiment of the present invention. A photo printer 1 according to the third embodiment of the present invention further includes cleaning means for removing foreign substances attached to the platen roller R2.

As shown in FIGS. 11 and 12, a brush 71 is provided as the cleaning means. In detail, the base 10 has a front end 16 bent upward from the bottom surface thereof, and the cleaning means includes a body 70 fixed to the front end 16 of the base 10 and the brush 71 disposed on the body 70.

The brush 71 comes into contact with the platen roller R2, while the platen roller R2 is being rotated, and at this time, the foreign substances attached to the platen roller R2 are transferred to the brush 71 and thus removed from the platen roller R2.

The brush 71 removes the foreign substances physically or by means of electrostatic absorption.

FIG. 13 shows another example of the cleaning means.

Instead of the brush 71, as shown, a fabric pad 80 is provided as the cleaning means. Also, the fabric pad 80 comes into contact with the platen roller R2, and while the platen roller R2 is being rotated, the foreign substances attached to the platen roller R2 are transferred to the fabric pad 80.

Desirably, the fabric pad 80 is an electrostatic pad and is fixed to the front end 16 of the base 10.

Hereinafter, an explanation on an operation of the photo printer 1 according to the third embodiment of the present invention will be in detail given.

As shown in FIG. 11 or 12, the photo printer 1 according to the third embodiment of the present invention is configured to allow the brush 71 or the fabric pad 80 to come into close contact with the outer peripheral surface of the platen roller R2.

If the platen roller R2 is rotated, accordingly, the foreign substances attached to the platen roller R2 are transferred to the brush 71 or the fabric pad 80. As a result, defects can be prevented from occurring upon the rotation period of the platen roller R2.

Further, the foreign substances attached to the outer peripheral surface of the platen roller R2 can be prevented from being transferred to the head 20, thereby avoiding vertical lines from appearing on an image.

INDUSTRIAL APPLICABILITY

According to the present invention, the photo printer is capable of accurately forming a gap between the head and the platen roller to a set degree, while being not under the influence of the mechanical error generated from the stopper and the locking projection or the assembling error generated when the head is coupled to the base in the conventional practices.

[Sequence Listing Free Text]

Korean Patent Application Laid-open No. 10-2016-116966

The invention claimed is:

1. A photo printer comprising:

a base;

a pick-up roller protruding from a bottom surface of the base to feed a paper accommodated in the base in a forward direction;

a platen roller configured to discharge in the forward direction the paper fed by the pick-up roller, the platen roller including a platen roller shaft;

a head provided above the platen roller to apply heat to the paper;

a swing bracket having a front side, to which the head is coupled, and a rear side rotatably coupled to the base;

pressurizing means configured to press the swing bracket down to allow the swing bracket to come into close contact with the paper entering a space between the head and the platen roller; and a head supporting member inserted into the platen roller shaft, the head supporting member having an eccentric portion adapted to lift the head up through rotation of the head supporting member and thus to form a gap between the head and the platen roller.

2. The photo printer according to claim 1, wherein the head supporting member has gear teeth adapted to engage with gear teeth of a jig, so that the eccentric portion is rotated by rotation of the jig.

3. The photo printer according to claim 1, further comprising a fixing pin fixed to a side wall of the base, wherein the head supporting member includes an arch-shaped long hole, and the fixing pin passes the arch-shaped long hole so that the rotation of the head supporting member is limited by the arch-shaped long hole and the fixing pin.

4. The photo printer according to claim 1, wherein the base has open portions formed on both side walls thereof in such a manner as to detachably mount the platen roller shaft thereon.

5. The photo printer according to claim 4, wherein ring-shaped bushings whose diameters are greater than widths of the open portions are fitted to the platen roller shaft, and each ring-shaped bushing has D-cut portions linearly cut on portions of an outer peripheral surface thereof, so that the ring-shaped bushings pass through the open portions and are thus detachably mounted on the base.

6. The photo printer according to claim 5, wherein the base has seating portions open to a shape of a circle on both side walls thereof to seat the ring-shaped bushings onto ends of the open portions.

7. The photo printer according to claim 5, wherein each ring-shaped bushing is formed integrally with one side of a corresponding head supporting member.

8. The photo printer according to claim 1, further comprising cleaning means for removing foreign substances attached to the platen roller.

9. The photo printer according to claim 8, wherein the cleaning means is formed of a brush or fabric cleaning pad located on the front end of the base in such a manner as to come into contact with the platen roller.

* * * * *